US006763758B2

(12) United States Patent
Kemnitz et al.

(10) Patent No.: US 6,763,758 B2
(45) Date of Patent: Jul. 20, 2004

(54) MULTI-PART COOLED PISTON FOR AN INTERNAL COMBUSTION ENGINE

(75) Inventors: Peter Kemnitz, Leutenbach (DE); Dieter Messmer, Remseck (DE)

(73) Assignee: Mahle GmbH, Stuttgart (DE)

( * ) Notice: Subject to any disclaimer, the term of this patent is extended or adjusted under 35 U.S.C. 154(b) by 16 days.

(21) Appl. No.: 10/246,135

(22) Filed: Sep. 18, 2002

(65) Prior Publication Data

US 2003/0167918 A1 Sep. 11, 2003

(30) Foreign Application Priority Data

Mar. 9, 2002 (DE) ..... 102 10 570

(51) Int. Cl.[7] ..... F01B 31/08
(52) U.S. Cl. ..... 92/186; 92/255
(58) Field of Search ..... 92/186, 255; 123/193.6, 123/41.35

(56) References Cited

U.S. PATENT DOCUMENTS

| | | | | |
|---|---|---|---|---|
| 2,159,989 A | | 5/1939 | Hazen et al. | |
| 3,465,651 A | * | 9/1969 | Tromel | 92/186 |
| 5,081,968 A | * | 1/1992 | Bruni | 92/186 |
| 6,491,013 B1 | * | 12/2002 | Gaiser et al. | 92/186 |

FOREIGN PATENT DOCUMENTS

| | | | | |
|---|---|---|---|---|
| DE | 800 350 | | 7/1949 | |
| DE | 2 212 922 | | 9/1973 | |
| DE | 123 962 | | 12/1975 | |
| DE | WO 00/53913 A1 | * | 9/2000 | F02F/3/00 |
| EP | 0 604 223 | | 12/1993 | |
| FR | 753 615 | | 7/1934 | |
| JP | 60-143148 | | 9/1985 | |
| JP | 60-178345 | | 11/1985 | |
| WO | WO00/06882 | | 2/2000 | |

* cited by examiner

*Primary Examiner*—Edward K. Look
*Assistant Examiner*—Michael Leslie
(74) *Attorney, Agent, or Firm*—Collard & Roe, P.C.

(57) ABSTRACT

A multi-part cooled piston for an internal combustion engine comprises a one-piece piston upper part having a combustion bowl and an annular wall with a piston-ring part, and a one-piece piston lower part having a box-like piston skirt, and bosses to receive the piston pins joining the piston to the connecting rod and boss supports, which are joined to the piston skirt. A cooling channel is formed through the piston upper part and also the piston lower part and is limited thereby in its cross section. A reduction of the compression height and an increase of the heat load can be achieved with this piston despite increasing engine power. The piston can also be assembled without microstructural change. The piston upper part and the piston lower part are provided with support elements having seating faces, which form a first and a second seat. The support element comprising the first seat is provided with threads for screwing the two piston parts together, and in the screwed together condition of the piston upper part and piston lower part, the two piston parts are braced exclusively via the first and second seats.

13 Claims, 2 Drawing Sheets

MULTI-PART COOLED PISTON FOR AN INTERNAL COMBUSTION ENGINE

BACKGROUND OF THE INVENTION

1. Field of the Invention

The invention relates to a multi-part cooled piston for an internal combustion engine, comprising a one-piece piston upper part having a combustion bowl and an annular wall with piston-ring part, and a one-piece piston lower part having a box-like piston skirt, and bosses to receive the piston pins joining the piston to the connecting rod and boss supports, which are joined to the piston skirt. A cooling channel is formed through the piston upper part and piston lower part and is limited thereby in its cross section.

2. The Prior Art

Such pistons are known, for example, from German Patent No. 800350, German Unexamined Application No. 2212922, European Patent No. 0604223 A1, Japanese Patent No. 60-143148 and Japanese Patent No. 60-178345. These pistons are provided with substantially central screw couplings and thus have the known disadvantages of what are known as built pistons, in which, due to the point connection of the piston upper and lower parts, a relative motion causing wear is developed between two piston components under the combustion pressure. In order to achieve the advantage of these pistons that results from the connection of wear-resistant piston upper parts with piston lower parts made of light metal, without suffering the aforesaid disadvantages, the screw couplings have been shifted to the outer rim region of the piston, as is known, for example, from French Patent No. 753615 or U.S. Pat. No. 2,159,989. In general, these designs, which date from the 1930s, are not comparable with the concepts of modern pistons, since they were designed for much lower combustion-chamber pressures. In addition, it was not possible to embody combustion bowls in such designs.

East German Patent No. 123962 shows a piston in which a wear-resistant piston-ring area is created by mechanically joining—by screw coupling in this case—a piston base body containing a fire ring to the piston-ring area or to a part of the annular element forming part of the piston-ring area, and securing it against loosening. A disadvantage, however, is that only the piston-ring area is made of wear-resistant material, and high compression pressures cannot be achieved in combination with low overall piston height.

Besides the central or off-centered screw coupling as the joint between piston parts made of different materials, there are also known welding methods, such as the friction welding method of International Patent WO 00/06882. Therewith the piston upper and lower parts can be welded together relatively simply. This has the disadvantage in that welding changes material microstructure, thus leading to stress cracking. An even greater disadvantage, however, is the limitation on choice of materials for the parts to be joined.

SUMMARY OF THE INVENTION

It is therefore an object of the invention to provide a multi-part cooled piston for an internal combustion engine which permits a reduction of the compression height and an increase of the heat load despite increasing engine power, and which also permits assembly of the piston without microstructural change.

This object is accomplished by a piston comprising a piston upper part having a combustion bowl and an annular wall with piston-ring part, and a piston lower part having a box-like piston skirt, bosses to receive the piston pins joining the piston to the connecting rod and boss supports, which are joined to the piston skirt, and a cooling channel formed through the piston upper part and lower part and being limited thereby in its cross section.

According to this solution, the piston upper part and the piston lower part are provided with support elements having seating faces, which form a first and a second seat. The support element of the piston upper part and lower part comprising the first seat is provided with threads for screwing the two piston parts together. In the screwed together condition of the piston upper part and piston lower part, the two piston parts are supported exclusively via the first and second seats. The mechanical stability achieved thereby is superior to that of a welded joint between the piston parts, because of the absence of internal stresses. In particular, this stability is achieved by the arrangement of the seats relative to the piston diameter in such a way that the first seat is disposed radially inward and the second radially outward. These seats are disposed in different planes relative to the piston height, so that effective internal and external bracing is achieved.

According to the invention, one part of the support elements, which are constructed as an annular rib and an annular bearing rib, is provided with a thread for screw coupling of the piston parts, the wall structure of the annular rib being configured in such a way that elastic deformation in response to the combustion-chamber pressure exerted on the piston bottom can take place without diminishing the stability of the screw coupling. In particular, because of the positional arrangement of the support elements, which are defined by the radii that extend from the longitudinal axis of the piston in a radial direction to the outer surface of the piston, the flow of force from the piston bottom via the support elements to the boss supports or piston pins is effectively dissipated without overloading the piston material. Damage due to mechanical load, such as stress cracking, can therefore be effectively prevented.

Furthermore, the inventive design has the advantage that the centering of the piston upper part relative to the piston lower part takes place not by the screw coupling but by wall regions of a step-like structure of the support element that forms the second and therefore outer seat. Therefore, piston upper parts of heat-resisting steel and piston lower parts made of forged AFP steel can be joined particularly simply and inexpensively.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
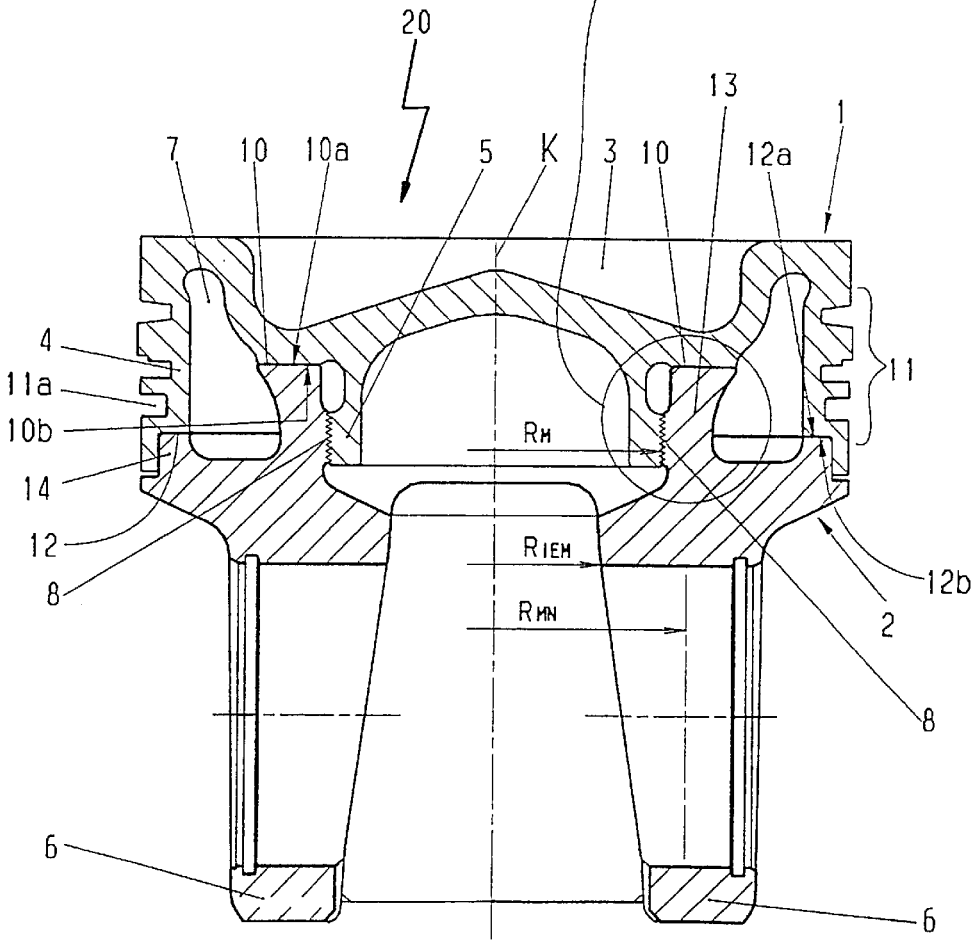
FIG. 1 shows a cross-sectional view of the piston according to the invention, cut in pin direction.

Referring now in detail to the drawings, FIG. 1 shows a multi-part cooled piston 20 comprising a piston upper part 1, which has a combustion bowl 3 and an annular wall 4 with piston-ring part 11, and a piston lower part 2, which has a box-like piston skirt 9, bosses for receiving the piston pins (not illustrated) joining the piston to the connecting rod and boss supports 6, which are joined to piston skirt 9. A cooling channel 7 is formed through piston upper part 1 and also piston lower part 2 and limited thereby in its cross section.

Piston upper part 1 is provided with a support element, which comprises an annular seating face 10*a* disposed on a bottom side remote from combustion bowl 3, a part of the horizontal cross-sectional face 12*a* of annular wall 4 and an annular rib 5. On piston lower part 2 there are also provided support elements, which comprise an annular load-bearing rib 13, cross-sectional face 10*b* of load-bearing rib 13 and an annular load-bearing ridge 14. A first plane and horizontal seat 10 for the two piston parts 1, 2 is formed by annular seating face 10*a* and cross-sectional face 10*b* of annular load-bearing rib 13, seat 10 being disposed radially inward relative to piston diameter D and forming an inner support. A second, plane and horizontally disposed seat 12 for the two piston parts comprises the horizontal part of cross-sectional face 12*a* of annular wall 4 and cross-sectional face 12*b* of annular load-bearing ridge 14, so that there is obtained a stepped structure of load-bearing ridge 14, by which the piston upper part is centered.

Figure 2:
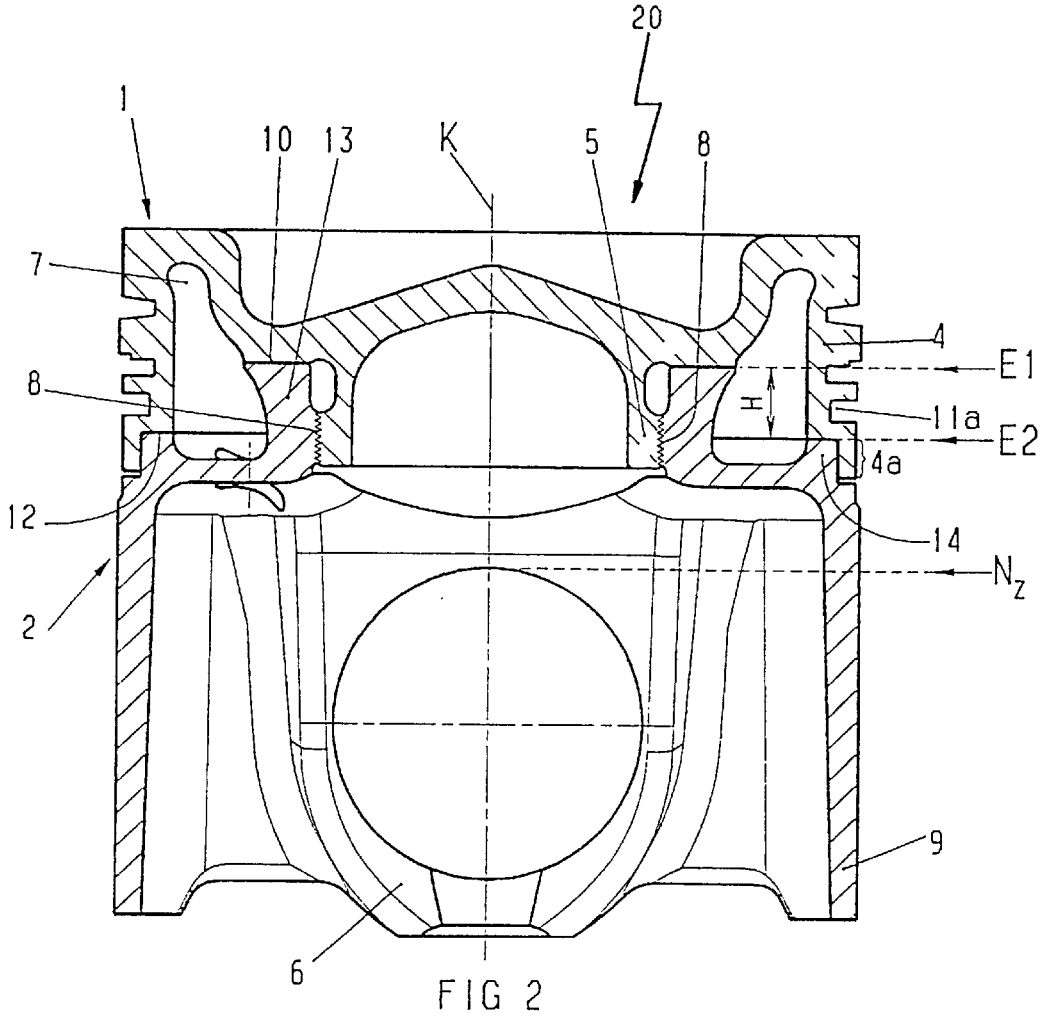
FIG. 2 shows a cross-sectional view of the piston, cut in a pressure-backpressure direction.

As is evident from FIG. 1 and FIG. 2, annular wall 4, which with its cross-sectional face forms an air gap in an axial direction relative to piston skirt 9, is essentially used for centering wall region 4*a* (FIG. 2). Relative to the piston height, the first and second seats are disposed in different horizontal planes, E1 and E2 respectively, which are characterized by height H.

Figure 3:
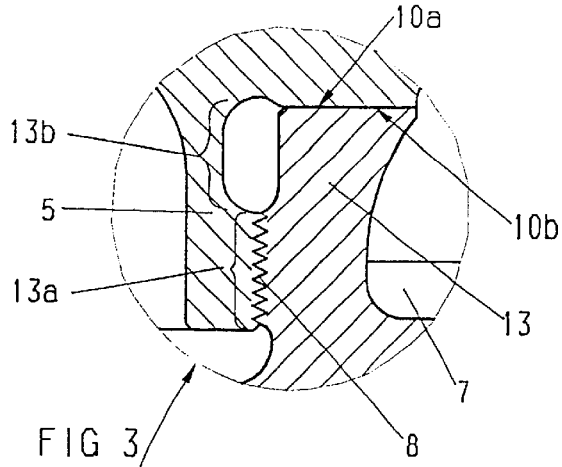
FIG. 3 shows an enlarged detail of FIG. 1, marked by a circle.

A thread 8 for screwing piston upper part 1 and piston lower part 2 together is configured as a male thread on the circumferential side of annular rib 5 disposed radially outward relative to the piston diameter and as a female thread on the circumferential side of annular load-bearing rib 13 disposed radially inward. As is evident from FIG. 3, annular rib 5 extending toward the pin boss has in the axial piston direction an at least partly cylindrical or conical portion 13*a*, which is threaded and oriented parallel to the piston axis (K). The cylindrically or conically shaped portion 13*a* of annular rib 5 is followed in the direction of combustion bowl 3 by a portion 13*b* with reduced wall thickness. In this way there is created an elastic region which can absorb the mechanical stresses generated by the combustion-chamber pressure and dissipate them to the piston pins.

The threaded circumferential side of annular rib 5 has a radius $R_{outer\ surface}$ ($R_M$) which lies in the range $R_{outer\ surface} < R_{middle\ of\ boss\ support}$ ($R_{MN}$) and $R_{outer\ surface} > R_{inner\ end\ of\ boss\ support}$ ($R_{IEM}$), all radii being defined as extending from the longitudinal axis (K) of the piston in a radial direction toward the outer surface of the piston and the radii at "middle of boss support" and "inner end of boss support" being relative to the zenith ($N_z$) of the boss bore, as illustrated in FIGS. 1 and 2.

The two piston parts are assembled by centering piston upper part 1 relative to piston lower part 2 by means of wall region 4*a* projecting relative to load-bearing rib 13 and then screwing it onto the piston lower part. The height H (spacing of planes E1, E2) of first seat 10 relative to second seat 12 is adjusted in such a way that outer seating faces 12*a*, 12*b* come into contact first, at a height difference of about 50 $\mu$m, and then inner seating faces 10*a*, 10*b* come into contact after further turning movement to eliminate the height difference, so that cooling channel 7 produced in the condition in which piston upper part 1 is completely screwed together with piston lower part 2 is sealed only by seating faces 10*a*, 10*b* and 12*a*, 12*b*. By virtue of the large diameter, the thread is self-locking. In addition, however, a radially applied clamping sleeve can be provided underneath the 3rd groove.

Piston upper part 1 can be made of an oxidation-resistant and/or heat-resisting material. The steels typically used are those with chromium contents of ≧4% from the material groups of the chemically resistant steels according to DIN EN 10027-2 (steel group numbers 1.4x xx), such as non-rusting, high-temperature or heat-resistant steels, as well as from the material group of the alloyed tool steels, such as alloyed hot-work tool steels.

The piston lower part is made of a precipitation-hardening ferritic-pearlitic steel or quenched and tempered steel, steel grades 38MnVS6 or 42CrMo4 (according to German Steel and Iron Material Sheet 101) typically being used.

Accordingly, while only a few embodiments of the present invention have been shown and described, it is obvious that many changes and modifications may be made thereunto without departing from the spirit and scope of the invention.

What is claimed is:

1. A multi-part cooled piston for an internal combustion engine, comprising:

a piston upper part having a combustion bowl and an annular wall with a piston-ring part;

a piston lower part having a box-like piston skirt, bosses to receive piston pins joining the piston to a connecting rod and boss supports, which are joined to the piston skirt;

a cooling channel formed by the piston upper part and the piston lower part and being limited thereby in cross section;

support elements on the piston upper part and lower part, said support elements having seating faces which form a first and a second seat, wherein the support element comprising the first seat is provided with threads for screwing the piston upper and lower parts together, said threads being configured as a male thread on a circumferential side of an annular rib disposed radially outward relative to a piston diameter and as a female thread on a circumferential side of an annular load-bearing rib disposed radially inward, wherein in a screwed together condition of the piston upper part and piston lower part, the two piston parts are supported exclusively via the first and second seats.

2. A multi-part cooled piston according to claim 1, wherein the first and second seats are disposed in respectively different horizontal planes relative to a piston height.

3. A multi-part cooled piston according to claim 1, wherein the first seat is disposed radially inward relative to a piston diameter and forms an inner support for the piston upper part, and the second seat is disposed radially outward relative to the piston diameter and forms an outer support for the piston upper part.

4. A multi-part cooled piston according to claim 1, wherein the support element of the piston upper part comprises one of the seating faces disposed on a bottom side remote from the combustion bowl, a part of a horizontal cross-sectional face of the annular wall and an annular rib, and wherein the support element of the piston lower part comprises an annular load-bearing rib, a cross-sectional face of the annular load-bearing rib, an annular load-bearing ridge and a cross-sectional face of the annular load-bearing ridge.

5. A multi-part cooled piston according to claim 4, wherein the annular rib extending toward the pin boss has in an axial piston direction on at least partly cylindrical or conical portion, which is threaded and oriented parallel to a piston axis (K).

6. A multi-part cooled piston according to claim 4, wherein the seating faces of the first seat comprise the seating face disposed on a bottom side remote from the combustion bowl, and the cross-sectional face of the load-bearing rib.

7. A multi-part cooled piston according to claim 1, wherein the piston upper part is made of an oxidation-resistant or heat-resisting material and the piston lower part is made of a precipitation-hardening ferritic-pearlitic steel or quenched and tempered steel.

8. A multi-part cooled piston for an internal combustion engine, comprising:

a piston upper part having a combustion bowl and an annular wall with a piston-ring part;

a piston lower part having a box-like piston skirt, bosses to receive piston pins joining the piston to a connecting rod and boss supports, which are joined to the piston skirt;

a cooling channel formed by the piston upper part and the piston lower part and being limited thereby in cross section;

support elements on the piston upper part and lower part, said support elements having seating faces which form a first and a second seat, wherein the support element comprising the first seat is provided with threads for screwing the piston upper and lower parts together, and wherein the support element of the piston upper part comprises one of the seating faces disposed on a bottom side remote from the combustion bowl, a part of a horizontal cross-sectional face of the annular wall and an annular rib, and wherein the support element of the piston lower part comprises an annular load-bearing rib, a cross-sectional face of the annular load-bearing rib, an annular load-bearing ridge and a cross-sectional face of the annular load-bearing ridge;

wherein in a screwed together condition of the piston upper part and piston lower part, the two piston parts are supported exclusively via the first and second seats, and wherein the annular rib extending toward the pin boss has in an axial piston direction an at least partly cylindrical on conical portion, which is threaded and oriented parallel to a piston axis (K), and wherein the cylindrical or conical portion of the annular rib is followed in a direction of the combustion bowl by a portion with reduced wall thickness.

9. A multi-part cooled piston for an internal combustion engine, comprising:

a piston upper part having a combustion bowl and an annular wall with a piston-ring part;

a piston lower part having a box-like piston skirt, bosses to receive piston pins joining the piston to a connecting rod and boss supports, which are joined to the piston skirt;

a cooling channel formed by the piston upper part and lower part, said support elements having seating faces which form a first and a second seat, wherein the support element comprising the first seat is provided with threads for screwing the piston upper and lower parts together, wherein the support element of the piston upper part comprises one of the seating faces disposed on a bottom side remote from the combustion bowl, a part of a horizontal cross-sectional face of the annular wall and an annular rib, and wherein the support element of the piston-lower part comprises an annular load-bearing rib, a cross-sectional face of the annular load-bearing rib, an annular load-bearing ridge and a cross-sectional face of the annular load-bearing ridge, wherein in a screwed together condition of the piston upper part and piston lower part, the two piston parts are supported exclusively via the first and second seats,and wherein a radius $R_{outer\ surface}$ ($R_M$) of the annular rib lies in a range $R_{outer\ surface}<R_{middle\ of\ boss\ support}$ ($R_{MN}$) and $R_{outer\ surface}>R_{inner\ end\ of\ boss\ support}$ ($R_{IEM}$), all radii being defined as extending from a longitudinal axis (K) of the piston in a radial direction toward an outer surface of the piston and the radii at "middle of boss support" and "inner end of boss support" being relative to a zenith ($N_z$) of the boss bore.

10. A multi-part cooled piston for an internal combustion engine, comprising:

a piston upper part having a combustion bowl and an annular wall with a piston-ring part;

a piston lower part having a box-like piston skirt, bosses to receive piston pine joining the piston to a connecting rod and boss supports, which are joined to the piston skirt;

a cooling channel formed by the piston upper part and the piston lower part and being limited thereby in cross section;

support elements on the piston upper part and lower part, said support elements having seating faces which form a first and a second seat, wherein the support element comprising the first seat is provided with threads for screwing the piston upper and lower parts together, wherein the support element of the piston upper part comprises one of the seating faces disposed on a bottom side remote from the combustion bowl, a part of a horizontal cross-sectional face of the annular wall and an annular rib, and wherein the support element of the piston lower part comprises an annular load-bearing rib, a cross-sectional face of the annular load-bearing rib, an annular load-bearing ridge and a cross-sectional face of the annular load-bearing ridge, and wherein the seating faces of the first seat comprise the seating face disposed on a bottom side remote from the combustion bowl, and the cross-sectional face of the load-bearing rib, and wherein in a screwed together condition of the piston upper part and piston lower part, the two piston parts are supported exclusively via the first and second seats, and wherein the first seat is disposed approximately centrally relative to the piston ring part.

11. A multi-part cooled piston for an internal combustion engine, comprising:

a piston upper part having a combustion bowl and an annular wall with a piston-ring part;

a piston lower part having a box-like piston skirt, bosses to receive piston pins joining the piston to a connecting rod and boss support, which are joined to the piston skirt;

a cooling channel formed by the piston upper part and the piston lower part and being limited thereby in cross section;

support elements on the piston upper part and lower part, said support elements having seating faces which form a first and a second seat, wherein the support element comprising the first seat is provided with threads for screwing the piston upper and lower parts together, wherein in a screwed together condition of the piston upper part and piston lower part, the two piston parts are supported exclusively via the first and second seats, and wherein the second seat comprises a part of an entire cross-sectional face of the annular wall and of a cross-sectional face of an annular load-bearing ridge, so that there is obtained a stepped structure of the load-bearing ridge, by which the piston upper part is centered.

12. A multi-part cooled piston according to claim 11, wherein the second seat is disposed underneath a lowest piston-ring groove at a distance.

13. A multi-part cooled piston for an internal combustion engine, comprising:

a piston upper part having a combustion bowl and an annular wall with a piston-ring part;

a piston lower part having a box-like piston skirt, bosses to receive piston pins joining the piston to a connecting rod and boss supports, which are joined to the piston skirt;

a cooling channel formed by the piston upper part and the piston lower part and being limited thereby in cross section;

support elements on the piston upper part and lower part, said support elements having seating faces which form a first and a second seat, wherein the support element comprising the first seat is provided with threads for screwing the piston upper and lower parts together, wherein in a screwed together condition of the piston upper part and piston lower part, the two piston parts are supported exclusively via the first and second seats, and wherein the cooling channel produced when the piston upper part is screwed together with the piston lower part is sealed only by the seating faces.

* * * * *